United States Patent [19]

Panagin

[11] 4,362,109

[45] Dec. 7, 1982

[54] RAILWAY VEHICLE TRUCKS

[75] Inventor: Romano Panagin, Turin, Italy

[73] Assignee: Centro Ricerche Fiat S.p.A., Turin, Italy

[21] Appl. No.: 142,805

[22] Filed: Apr. 22, 1980

[30] Foreign Application Priority Data

May 24, 1979 [IT] Italy ..... 68110 A/79

[51] Int. Cl.[3] ..... B61F 3/08; B61F 5/16; B61F 5/30; B61F 5/38

[52] U.S. Cl. ..... 105/182 R; 105/169; 105/189; 105/199 C; 105/199 R; 105/206 R; 105/218 A; 105/226

[58] Field of Search ..... 105/180, 182 R, 199 R, 105/206, 218 A, 226

[56] References Cited

U.S. PATENT DOCUMENTS

| | | | |
|---|---|---|---|
| 1,875,380 | 9/1932 | Howard et al. | 105/182 R |
| 2,119,062 | 5/1938 | Stout et al. | 105/226 |
| 2,253,042 | 8/1941 | Muchnic | 105/182 R |
| 2,473,714 | 6/1949 | Krotz | 105/182 R |
| 2,499,087 | 2/1950 | Bourdon | 105/199 R |
| 2,892,420 | 6/1959 | Cooper | 105/180 X |
| 3,841,232 | 10/1974 | Hess | 105/218 A X |

*Primary Examiner*—Joseph F. Peters, Jr.
*Assistant Examiner*—Howard Beltran
*Attorney, Agent, or Firm*—Sughrue, Mion, Zinn, Macpeak & Seas

[57] ABSTRACT

A railway-vehicle truck has a support structure in the form of a horizontal rectangular plate the opposite ends of which carry respective transverse tubular supports. Each tubular support mounts a shaft the two ends of which carry respective arms. Each arm rotatably mounts a railway wheel. Between each shaft and its corresponding tubular support are provided bushes of elastomeric material which permit misalignment of the shaft and support as the vehicle traverses a bend. The horizontal plate of the support structure is formed with a rectangular aperture mounting a sliding block for sliding movement transversely of the truck, though limited play is also provided for longitudinally of the truck. A truck pivot pin extends vertically down from the vehicle body through a central hole in the sliding block. Upper and lower plate elements are carried by the pivot pin and serve to sandwich upper and lower annular elements of elastomeric material between themselves and the facing surfaces of the support structure.

14 Claims, 4 Drawing Figures

RAILWAY VEHICLE TRUCKS

FIELD OF THE INVENTION

The present invention relates to railway vehicles and in particular to trucks for such vehicles.

The object of the present invention is to provide a railway vehicle truck which has a low weight and bulk, is simple and inexpensive to manufacture and maintain, and gives a comfortable ride.

SUMMARY OF THE INVENTION

With a view to achieving this object, the present invention provides a railway vehicle truck comprising:

- a support structure with a central part in the form of a horizontal plate defining a rectangular aperture the major axis of which is directed transversely of the truck, the support structure further comprising two tubular transverse supports rigid with the ends of the plate opposite one another in the direction of extent of the longitudinal axis of the truck,
- two shafts rotatably mounted in the said tubular supports,
- bushes of elastomeric material interposed between said shafts and the said tubular supports whereby to enable misalignment therebetween,
- a respective pair of arms carried by each said shaft with each arm carrying a transversely projecting wheel axle,
- a respective wheel mounted on each said wheel axle,
- a helical suspension spring and an hydraulic shock absorber associated with each arm and extending upwards from the region of the free end thereof for connection to the vehicle body,
- a rectangular sliding block so mounted in the said rectangular aperture of the support structure as to be capable of sliding movement along the major axis of the aperture and of limited displacement along the minor axis of the aperture, the sliding block having a central hole the axis of which is vertical,
- an upper plate element connected to the said vehicle body,
- a truck pivot pin carried by said upper plate element and projecting downwardly therefrom, the pivot pin extending through the said hole in the sliding block to terminate below the said central plate part of the support structure,
- a lower plate element fixed to the lower end of the said pivot pin,
- a first elastomeric-material annular element clamped between the said upper plate element and the upper surface of the said central plate part, and
- a second elastomeric-material annular element clamped between the lower surface of the central plate part and the said lower plate element, each of the annular elements of elastomeric material having a rigidity about the longitudinal axis of the truck which is less than its rigidity about the transverse axis of the truck.

Preferred embodiments of the truck possess a number of important advantages, including:

- the possibility of mass production of the parts constituting the truck;
- a reduction in weight of the truck, and therefore a reduction in total weight of the railway vehicle of which the bogie truck forms a part,

- utilisation of a single suspension stage working according to the three main axes of inertia of the vehicle, and consequent elimination of the second suspension stage;
- distribution of the weight of the body of the vehicle on four supports and therefore the possibility of utilising vehicle bodies with a simplified shell structure;
- less degradation of the railway track, due to the increased flexibility of the suspension components in series with the wheels,
- reduction of the stresses on the axles of the wheels,
- reduction of the wear of the rolling cone of each wheel,
- reduction of the static and dynamic stresses on the vehicle body due to the greater number of supports and to the smaller vertical accelerations present;
- the possibility of self steering of the arms carrying the wheels, in such a way as to nullify, when travelling around a curve, misalignment of the wheels with respect to the rails,
- the possibility of each wheel, independently from the others, absorbing possible vertical nonuniformities of the line,
- less degradation of the rails due to a reduction in the unsprung weight as compared with conventional trucks.

BRIEF DESCRIPTION OF THE DRAWINGS

A truck embodying the invention will now be particularly described, by way of example, with reference to the accompanying diagrammatic drawings, in which.

DESCRIPTION OF THE PREFERRED EMBODIMENT

Figure 1:
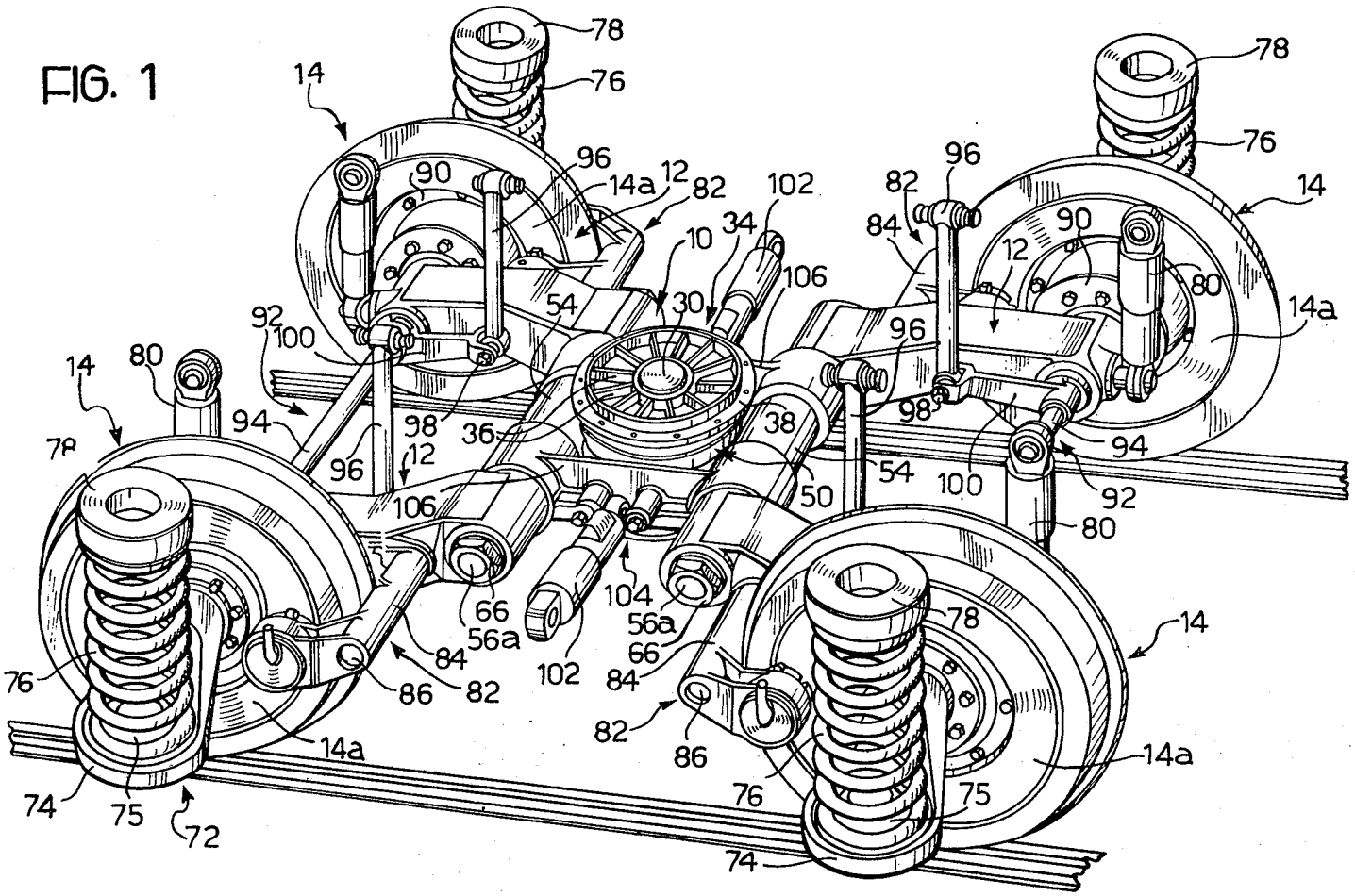
FIG. 1 is a perspective view of the truck.
Figure 2:
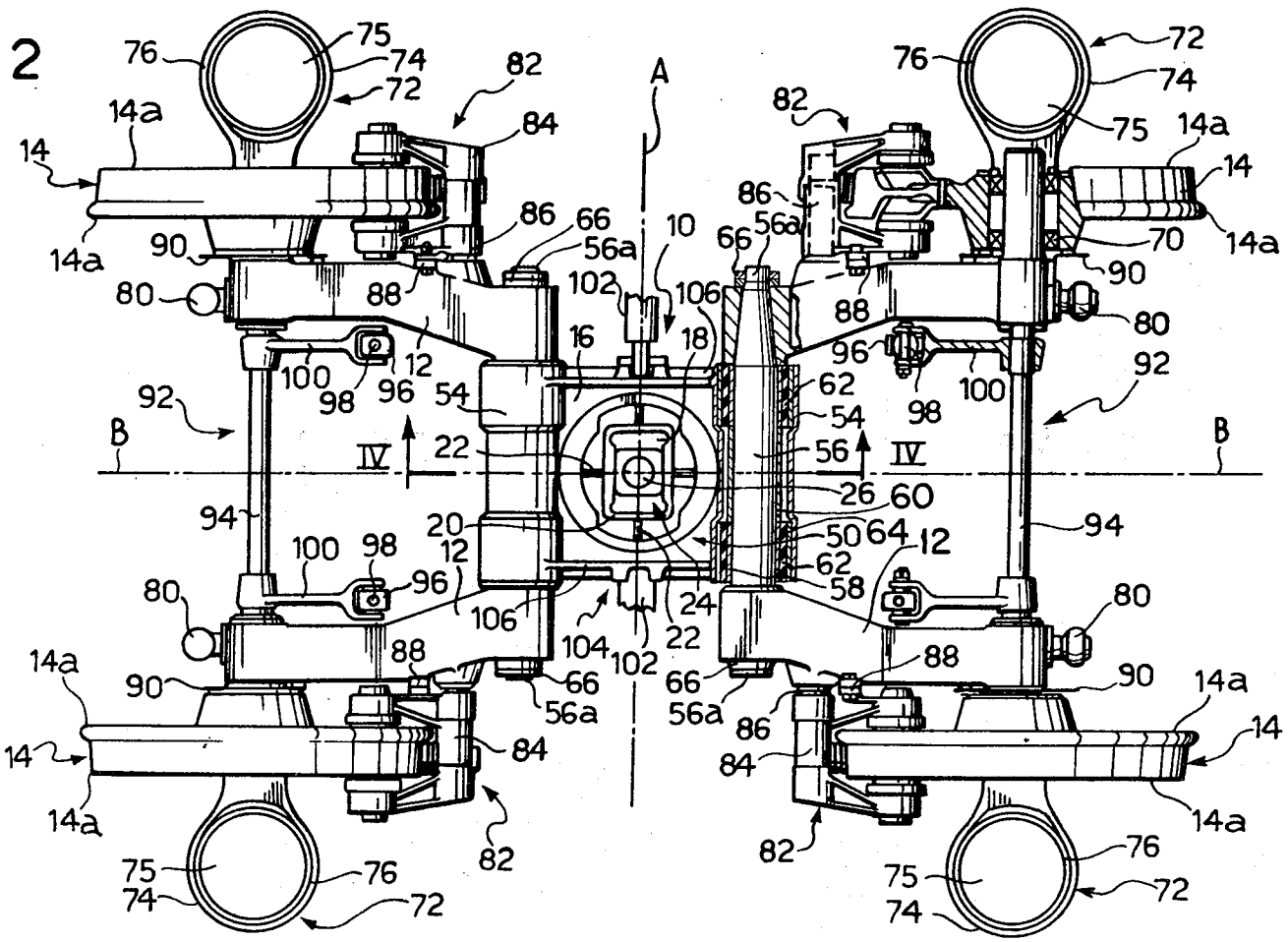
FIG. 2 is a plan view of the truck.

As shown in FIGS. 1 and 2, the truck basically comprises a central support structure 10 to which are pivoted four arms 12 each rotatably mounting a wheel 14.

Figure 3:
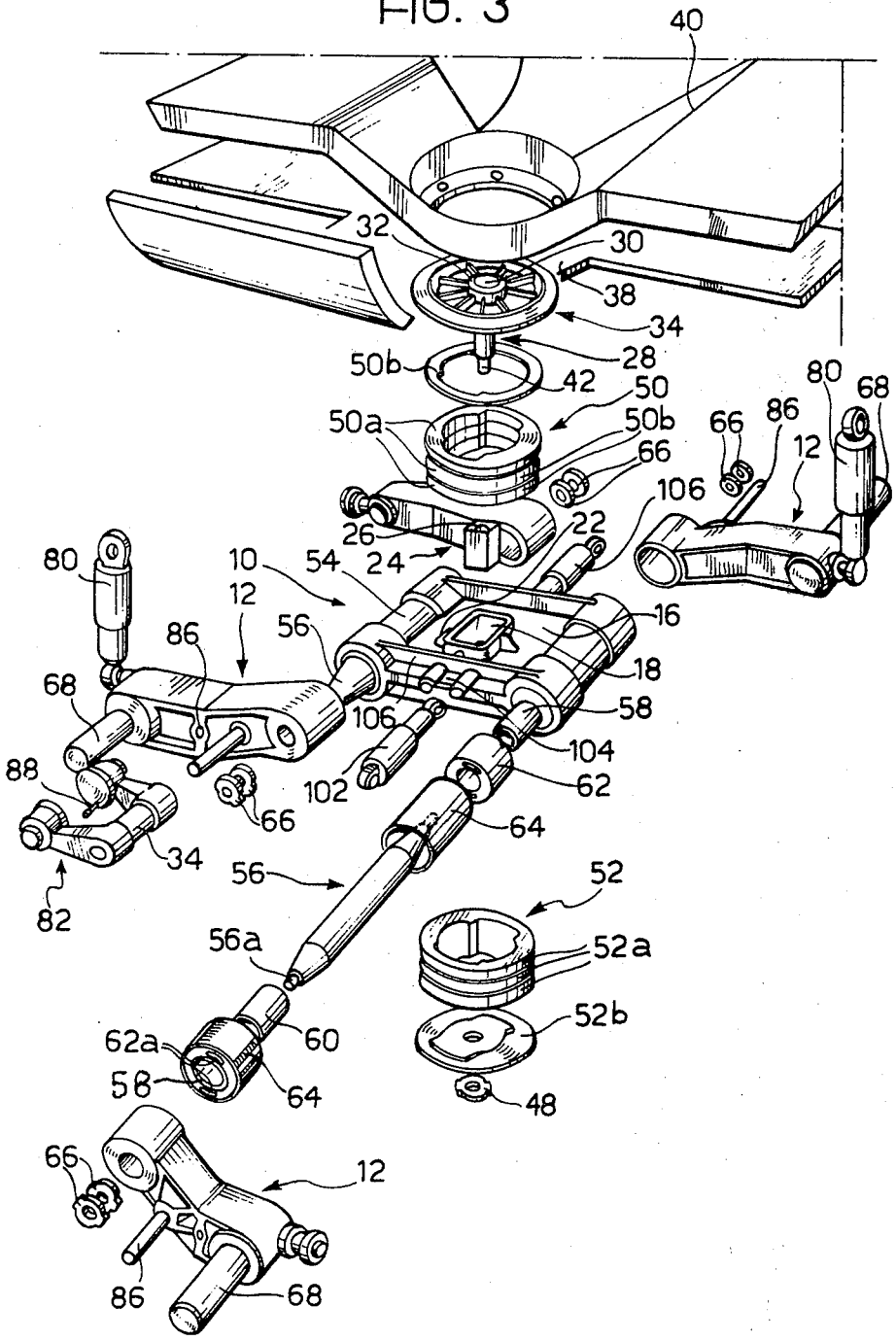
FIG. 3 is an exploded perspective view of a part of the truck.

The support structure 10, which is made as a single piece (for example, as an aluminium casting) has a central part 16 in the form of a horizontal rectangular plate provided with a central rectangular aperture 18 the longer sides of which are directed parallel to the transverse axis A of the truck. The aperture 18 is formed in a central thickened portion of the plate 16 and is therefore effectively bounded, on both sides of the plate 16, by upstanding walls 20 (see FIG. 3), these walls 20 being buttressed by reinforcing ribs 22 projecting from the plate 16.

Axially positioned within the aperture 18 is a sliding block 24 of self lubricating plastics material. The block 24 is of a vertically-elongate parallelepiped form with a square horizontal section and with its longer sides slightly greater in length than the depth of the aperture 18. The sliding block 24 is slidably mounted in the aperture 18 for movement along the transverse axis A of the truck and is, moreover, free to perform limited displacements within this aperture 18 in the direction of the longitudinal axis B of the truck. The permitted travel of the block 24 along the transverse axis A is preferably in the region of 45 mm, whilst its permitted movement in the direction of the longitudinal axis B is preferably around 5 mm.

Figure 4:
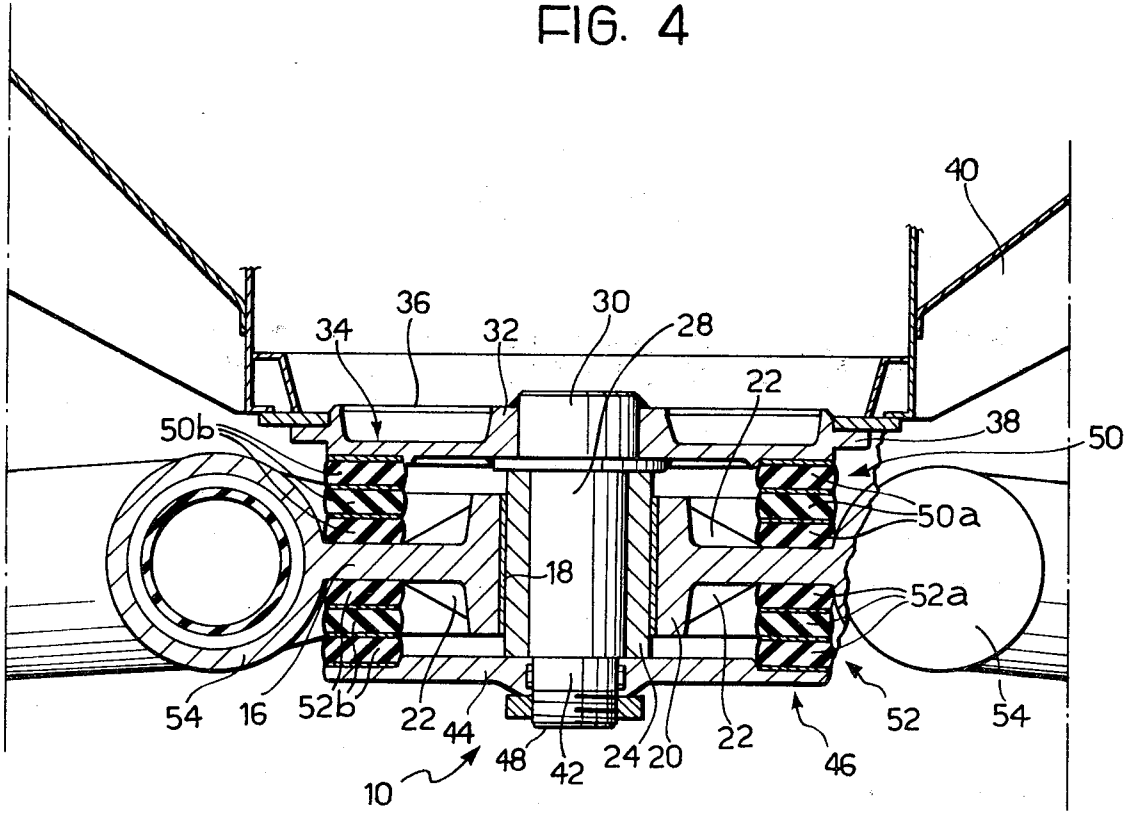
FIG. 4 is a longitudinal section on the line IV—IV of FIG. 2 to an enlarged scale.

The sliding block 24 is provided centrally with a cylindrical hole 26 which has a vertical axis and is traversed in a rotatable manner by a vertical pivot pin 28. The pin 28 has an upper enlargement 30 (see FIG. 4) rigidly fixed to a hub 32 of an upper horizontal disc 34 the upper face of which is provided with spokes 36. In addition, the disc 34 has an annular peripheral flange 38 which is connected by bolts to the bottom of the body 40 of a railway vehicle.

The pivot pin 28 has a lower threaded portion 42 of reduced diameter which traverses a hub 44 of a lower horizontal disc 46. The lower disc 46 is held in position at the lower end of the pivot pin 28 by means of a threaded ring 48 screwed onto the threaded pin portion 42. Clamped between the upper face of the plate 16 and the upper disc 34 is a first annular element 50 of elastomeric material; similarly, between the lower face of the plate 16 and the lower disc 46 is clamped a second annular element 52 of elastomeric material. Both annular elements 50 and 52 have their axes vertical and are identical with one another. In the example illustrated, each element 50 and 52 is constituted by a stack of superimposed rings 50*a*, 52*a* welded by means of vulcanisation to intermediate metal rings 50*b*, 50*b*.

The annular elements 50 and 52 are subjected to an axial pre-compression generated by the tightening up of the threaded ring 48 on the lower end portion 42 of the pivot pin 28. As is illustrated in detail in FIGS. 2 and 3, each annular element 50, 52 has lateral portions of radially reduced thickness arranged opposite the shorter sides of the aperture 18. As a result, the rigidity of the annular elements 50, 52 in relation to rotation about the transverse axis A of the truck is greater than their rigidity in relation to rotation about the longitudinal axis B of the truck. The function of these annular elements 50, 52 of elastomeric material is, as will be more fully described below, that of exercising a resilient restoring force, both in respect of transverse and longitudinal displacements of the sliding block 24 in the aperture 18, and in respect of rotations of the truck about the pivot pin 28. In addition, the annular elements 50 and 52 have the function of preventing infiltration of water or dust to the central portion of the pin 28 from externally of the support structure 10.

The transverse sides of the plate 16 are integral with respective transverse tubular supports 54 within which are rotatably mounted respective shafts 56. Each end of each shaft 56 projects from the corresponding tubular support 54 and carries by means of a rigid coupling, a respective one of the arms 12. Coaxially interposed between each of the shafts 56 and the corresponding tubular support 54, are a pair of rigid end sleeves 58 separated from one another by a spacer 60, a pair of bushes 62 of elastomeric material surrounding the sleeves 58, and a pair of outer sleeves 64 surrounding the bushes 62 of elastomeric material. The bushes 62 of elastomeric material are preferably of the type commercially known under the mark "Sutuco" and made by the Italian firm SAGA of Milan. These bushes 62 are provided above and below with axially extending slot-like holes 62*a* and therefore have a radial rigidity dependent on the direction of the applied load. The function of the bushes 62 of elastomeric material is to permit misalignment between the shaft 56 and the corresponding tubular support 54 to allow on the one hand, self steering of the arms 12 carrying the wheels 14 when the truck is traversing a curve, in such a way as to nullify any misalignment of the wheels 14 with respect to the rails, and on the other hand to permit rolling oscillations of these arms 12 in such a way as to allow the wheels 14 to accommodate possible nonuniformities of the rail-road track. As a result of this arrangement, each shaft 56 will only be subject to simple flexural stresses, and not to twisting forces.

Each arm 12 is disposed substantially parallel to the longitudinal axis B of the truck and, as previously mentioned, is connected at one end to the corresponding shaft 56 by means of a rigid coupling, for example a conical coupling. The locking of the arm 12 with respect to the shaft 56 is obtained by means of threaded rings 66 screwed onto a corresponding threaded end part 56*a* of the shaft 56.

Adjacent its distal end each arm 12 mounts an outwardly-projecting axle 68 which rotatably supports a respective wheel 14, with the interposition of counterposed taper roller bearings 70 (see FIG. 2). The distal end of the axle 68 carries a projecting support 72 in the form of a horizontal circular base 74 against which reacts, with the interposition of a block 75 of elastomeric material, the lower end of a helical suspension spring 76. The upper end of the helical spring 76 reacts, with the interposition of another block 78 of elastomeric material, against the bottom of the body 40 of the railway vehicle. The four springs 76 associated with the wheel axles 68 constitute a single stage suspension for the body 40 on the truck. In this way, the structural weight of the body 40 passes directly to the wheels 14 through the springs 76, without stressing intermediate elements. Moreover, the sharing of the weight of the body between eight supports (four on each of two trucks) permits the structures for restraining the body to be of limited weight, and also permits the use of the bodies with a shell structure. The provision of the blocks 75 and 78 against which the ends of the springs 76 react, permits the transverse rigidity of the springs 76 to be reduced. Moreover, lateral or rotational displacements of the truck with respect to the body are taken up both by the springs 76 and by the blocks 75 and 78.

Associated with the suspension springs 76 are dampers constituted by four vertical hydraulic shock absorbers 80 each of which is interposed between the free end of one of the arms 12 and the body 40 of the vehicle. Suitable buffers of elastomeric material (not illustrated) are incorporated in the shock absorbers 80, and constitute resilient vertical end-of-travel stops both against compression and extension.

Each wheel 14 is constituted by a unitary cold-rolled steel body. Each face of each wheel 14 carries an annular brake "disc" 14, the two brake "discs" associated with the same wheel being engageable by the brake pads of a brake caliper 82. The brake calipers 82 are actuated by a fluid under pressure. Each caliper 82 is provided with a tubular member 84 which is rotatably mounted on a transverse pivot pin 86 projecting from the corresponding arm 12. Anti-wear bushes, not illustrated, are interposed between the tubular member 84 and the pin 86. The caliper 82 is locked against rotation with respect to the pivot pin 86 by means of a transverse bolt 88 connecting the inner arm of the caliper 82 with the arm 12. Due to this mounting arrangement, the replacement of the brake pads of the caliper 82 can be effected in a simple and rapid manner by rotating the corresponding caliper 82 outwardly from the wheel 14 after removal of the associated bolt 88.

Each wheel 14 is provided with an anti-skid device comprising a phonic wheel 90 keyed to the inner face of the wheel 14, and an electromagnetic angular velocity sensor, not illustrated, carried by the arm 12.

Each pair of arms 12 connected to the same shaft 56 has an associated anti-roll bar indicated in its entirety by 92. The anti-roll bar 92 comprises a transverse shaft 94 connected by articulated joints at its ends to the inner ends of the axles 68 of the wheels 14, and a pair of vertical shafts 96 connected at their upper ends to the body 40 of the railway vehicle and pivoted at their lower ends about transverse pins 98 carried by a pair of longitudinal levers 100 fixed to the ends of the transverse shafts 94. The two transverse shafts 94 of each truck serve to maintain the spacing between the wheels 14 constant in the event of stresses directed along the axes of these wheels 14.

The truck further comprises a pair of transverse hydraulic shock absorbers 102 each pivoted at one end to the body and at the other end to a fork member 104 carried by a vertical longitudinal wall 106 of the support structure 10. The use of these transverse shock absorbers 102 may not be necessary since the above described configuration of the truck permits lateral oscillatory movements associated with the traversal of curves to be nullified.

A brief description will now be given of the stress conditions arising during use of the illustrated truck as one of a pair of truck supporting the opposite ends of the body of a railway vehicle.

The mass of the body of the railway vehicle is carried on eight suspension springs 76 (four for each truck) and these react directly on the wheels 14 of the truck without any intermediate members whatsoever. Each unit constituted by a pair of arms 12 connected to the same shaft 56 is therefore only subjected to vertical forces due to misalignment between the axis of each suspension spring 76 and the rolling plane of the wheel 14.

As previously mentioned, relative longitudinal and lateral movements between the body and the trucks are resisted by the annular elements 50 and 52 which become elastically deformed by an amount dependent not only on the applied loads but also on the direction of their application (this being so since the elements 50 and 52 have different stiffnesses along the transverse axes A and the longitudinal axes B of the trucks).

When the vehicle is traversing a curve, the centrifugal force acting on the centre of gravity of the body is laterally resisted by the annular elements 50 and 52 of both trucks, and to some degree also by the lateral rigidity of the suspension springs 76.

The elastomeric bushes 62 act in series with the annular elements 50 and 52 in the transmission of lateral forces from the vehicle body via the arms 12 and the wheels 14, to the rails.

For each pair of wheels 14, the turning effect produced in the horizontal plate by the contact force between the wheel on the outside of the curve and the outside rail, is resisted by the bushes 62 which are deformed both radially and conically. The overall result is that the corresponding shaft 56 is turned through a small angle relative to the structure 10 giving a self-steering effect with the wheels 14 and rails being kept in alignment so that contact of the guide flanges of the wheels with the rails is avoided; as a consequence, both wear of the flanges and wear of the rail itself are minimised.

Where the radii of curvature of the track exceeds 250 meters and the vehicle is subjected to non-compensated lateral accelerations of one meter/second$^2$, the wheels 14 are predisposed to oversteering, with the region of contact of the wheel with the rail lying behind the vertical plane passing through the axis of the wheel.

Due to their limited rigidity, the annular elements 50 and 52 and the bushes 62 provide substantially no vertical reaction to the centrifugal couple experienced by the vehicle while traversing a curve, this reaction being instead provided by the anti-roll bars 92 and by the helical suspension springs 76. Since the vertical forces acting at the ends of the anti-roll bars 92 are equal to one another and are approximately equidistant from the forces acting on the helical suspension springs 76, the units constituted by the arms 12 and their respective shafts 56 are not overloaded. The increase in loading of these units (including their elastomeric parts 50, 52, and 62) is therefore due solely to the horizontal contact forces between the wheels and the rail.

During braking of the railway vehicle, the forces set up elastically deform the annular elements 50 and 52 of elastomeric material until the sliding block 24 of each truck is brought into abutment with one of the longitudinal ends of the aperture 18. Again the bushes 62 of elastomeric material allow the central support structure 10 to be elastically isolated from the arms 12 carrying the wheels 14.

In level haulage conditions of the railway vehicle, the reaction of the annular elastomeric-material elements 50 and 52 in shear prevents the occurrence of sliding between the sliding block 24 and the edges of the aperture 18.

In all the operating conditions mentioned above, the transmission of the forces between the body of the railway vehicle and the wheels 14 takes place through resilient elements. This allows the elimination of unresisted sliding and the play between relatively movable parts of the truck so that vibrations of the truck are noticeably reduced.

I claim:

1. A railway truck, said truck having a longitudinal axis extending in the direction of movement of the vehicle, a support structure comprising a horizontal plate having central means defining a rectangular aperture having a major axis which is directed transversely to the longitudinal axis of the truck and a minor axis which is parallel to the longitudinal axis of the truck, said support structure further comprising two tubular transverse supports rigid with opposite ends of the plate in the direction of the longitudinal axis of the truck, two shafts rotatably mounted in said tubular supports, bushes of elastomeric material interposed between said shafts and said tubular supports, a respective pair of arms carried by each shaft with each arm carrying a transversely projecting wheel axle, a respective wheel mounted on each said wheel axle, a helical suspension spring and an hydraulic shock absorber associated with each arm and extending upwards therefrom, rectangular sliding block means mounted in said rectangular aperture of the support structure for substantial sliding movement along said major axis of the aperture and limited displacement along said minor axis of the aperture, the sliding block having a central hole the axis of which is vertical, an upper plate element adapted to be connected to a vehicle body, a truck pivot pin carried by said upper plate element and projecting downwardly therefrom, the pivot pin extending through said hole in the sliding block and terminating below said horizontal plate of the support structure, a lower plate element fixed to the lower end of said pivot pin, a first elastomeric-material annular element clamped between said upper plate element and the upper surface of said horizontal plate, and a second elastomeric-material annular element clamped between the lower surface of said horizontal plate and said lower plate element, each of the annular elements of elastomeric material having a rigidity about the longitudinal axis of the truck which is less than the rigidity about the transverse axis of the truck.

2. A truck according to claim 1, wherein each said annular element is constituted by a stack of rings comprising rubber rings alternating with metal rings, the metal rings being rigidly connected to said rubber rings.

3. A truck according to claim 1, wherein the radial rigidity of said bushes of elastomeric material differs between the vertical and horizontal planes.

4. A truck according to claim 1, wherein each said helical suspension spring reacts between a pair of blocks of elastomeric material.

5. A truck according to claim 1, wherein said support structure is provided on transversely opposite sides thereof with respective mounting forks each of which pivotally mounts a corresponding transverse hydraulic shock absorber.

6. A truck according to claim 1, wherein each said arm is connected to its corresponding shaft by means of a rigid coupling.

7. A truck according to claim 1, wherein said sliding block is made of self-lubricating plastics material and has a vertically elongate parallelepiped form of square horizontal section.

8. A truck according to claim 1, wherein said support structure is a single cast piece of aluminium.

9. A truck according to claim 1, wherein said horizontal plate of the support structure is provided with a thickened central portion in which said rectangular aperture is defined.

10. A truck according to claim 9, wherein said thickened central portion extends symmetrically on both sides of plate, reinforcing ribs being provided between said thickened central portion and the plate.

11. A truck according to claim 1, wherein each said arm supports an hydraulically-operable brake caliper arranged to cooperate with a pair of annular brake discs rigidly connected to the corresponding wheel.

12. A truck according to claim 11, wherein each said brake caliper includes a tubular support which is rotatably mounted on a transverse pivot pin projecting from the corresponding arm, removable rotation-prevention means being provided to normally lock the brake caliper against rotation about said pivot pin.

13. A truck according to claim 1, wherein a respective anti-roll bar is associated with each said shaft, each anti-roll bar extending between the two arms carried by the associated shaft.

14. A truck according to claim 13, wherein each anti-roll bar comprises a transverse shaft connected at its two ends by articulated joints to the inner ends of the said wheel axles carried by the associated pair of arms, a pair of vertical shafts, and a pair of levers carried by the transverse shaft, said vertical shafts being pivoted at their lower ends to said levers and adapted at their upper ends to be pivoted to the body of a railway vehicle.

* * * * *